US008211002B2

(12) United States Patent
Piramoon et al.

(10) Patent No.: US 8,211,002 B2
(45) Date of Patent: Jul. 3, 2012

(54) REINFORCED SWING BUCKET FOR USE WITH A CENTRIFUGE ROTOR

(75) Inventors: Sina Piramoon, San Jose, CA (US); Alireza Piramoon, Santa Clara, CA (US)

(73) Assignee: Fiberlite Centrifuge, LLC, Santa Clara, CA (US)

( * ) Notice: Subject to any disclaimer, the term of this patent is extended or adjusted under 35 U.S.C. 154(b) by 531 days.

(21) Appl. No.: 12/429,569

(22) Filed: Apr. 24, 2009

(65) Prior Publication Data

US 2010/0273629 A1 Oct. 28, 2010

(51) Int. Cl.
*B04B 5/02* (2006.01)

(52) U.S. Cl. ..... 494/20; 494/81; 422/548

(58) Field of Classification Search ..... 494/17–21, 494/31, 33, 43, 81, 16; 422/548
See application file for complete search history.

(56) References Cited

U.S. PATENT DOCUMENTS

| | | | | |
|---|---|---|---|---|
| 4,093,118 | A | 6/1978 | Sinn et al. | |
| 4,548,596 | A * | 10/1985 | Sutton et al. | 494/20 |
| 4,585,433 | A * | 4/1986 | Cole | 494/20 |
| 4,585,434 | A * | 4/1986 | Cole | 494/20 |
| 4,586,918 | A * | 5/1986 | Cole | 494/20 |
| 4,589,864 | A * | 5/1986 | Cole | 494/20 |
| 4,624,655 | A * | 11/1986 | Cole | 494/20 |
| 4,659,325 | A * | 4/1987 | Cole et al. | 494/20 |
| 4,670,004 | A | 6/1987 | Sharples et al. | |
| 4,738,656 | A | 4/1988 | Piramoon et al. | |
| 4,781,669 | A | 11/1988 | Piramoon | |
| 4,790,808 | A | 12/1988 | Piramoon | |
| 4,886,486 | A | 12/1989 | Grimm et al. | |
| 5,057,071 | A | 10/1991 | Piramoon | |
| 5,206,988 | A | 5/1993 | Piramoon | |
| 5,362,301 | A | 11/1994 | Malekmadani et al. | |
| 5,382,219 | A | 1/1995 | Malekmadani | |
| 5,411,465 | A | 5/1995 | Glen et al. | |

(Continued)

FOREIGN PATENT DOCUMENTS

DE 1 782 602 B 3/1972

(Continued)

OTHER PUBLICATIONS

Intellectual Property Office; Search and Examination Report in British Patent Application No. GB1004945.0 dated Jul. 16, 2010; 6 pages.

*Primary Examiner* — Charles E Cooley
(74) *Attorney, Agent, or Firm* — Wood, Herron & Evans, LLP

(57) ABSTRACT

A bucket is provided for use with a centrifuge rotor. The bucket includes a bucket body that has a side wall and a bottom wall. A pair of projections extend from the side wall on opposing sides of the bucket body and are configured for engagement with the centrifuge rotor. The bucket also includes reinforcing material coupled to the projections for restricting movement of the bucket body relative to the projections during centrifugation on the centrifuge rotor. The projections may include bushings that extend outwardly from the side wall for engaging corresponding pins on the centrifuge rotor. The projection may alternatively or additionally include pins for engaging corresponding journals on the centrifuge rotor. The bucket body may include a pair of diametrically opposed apertures, with each of the projections extending through one of the apertures.

10 Claims, 6 Drawing Sheets

U.S. PATENT DOCUMENTS

| | | | | | |
|---|---|---|---|---|---|
| 5,505,684 | A | | 4/1996 | Piramoon | |
| 5,527,257 | A | * | 6/1996 | Piramoon | 494/20 |
| 5,533,644 | A | | 7/1996 | Glen et al. | |
| 5,540,126 | A | | 7/1996 | Piramoon | |
| 5,545,118 | A | * | 8/1996 | Romanauskas | 494/20 |
| 5,562,582 | A | | 10/1996 | Malekmadani | |
| 5,562,584 | A | * | 10/1996 | Romanauskas | 494/20 |
| 5,601,522 | A | | 2/1997 | Piramoon | |
| 5,643,168 | A | | 7/1997 | Piramoon et al. | |
| 5,667,755 | A | * | 9/1997 | Baum et al. | 422/548 |
| 5,681,258 | A | | 10/1997 | Lowe et al. | |
| 5,683,341 | A | | 11/1997 | Giebeler | |
| 5,759,592 | A | | 6/1998 | Piramoon et al. | |
| 5,776,400 | A | | 7/1998 | Piramoon et al. | |
| 5,833,908 | A | | 11/1998 | Piramoon et al. | |
| 5,876,322 | A | | 3/1999 | Piramoon | |
| 5,972,264 | A | | 10/1999 | Malekmadani et al. | |
| 6,056,910 | A | | 5/2000 | Fritsch et al. | |
| 6,296,798 | B1 | | 10/2001 | Piramoon | |
| 6,482,342 | B1 | | 11/2002 | Malekmadani et al. | |
| 6,916,282 | B2 | * | 7/2005 | Aizawa | 494/20 |
| 7,150,708 | B2 | | 12/2006 | Lurz | |
| 2010/0184578 | A1 | * | 7/2010 | Piramoon et al. | 494/20 |
| 2010/0216622 | A1 | * | 8/2010 | Piramoon et al. | 494/21 |
| 2010/0273626 | A1 | * | 10/2010 | Piramoon | 494/20 |
| 2010/0273629 | A1 | * | 10/2010 | Piramoon et al. | 494/80 |
| 2011/0111942 | A1 | * | 5/2011 | Piramoon | 494/16 |
| 2011/0136647 | A1 | * | 6/2011 | Piramoon et al. | 494/20 |

FOREIGN PATENT DOCUMENTS

| | | | | |
|---|---|---|---|---|
| DE | 27 49 785 | A1 | | 5/1979 |
| EP | 0 176 970 | A2 | | 4/1986 |
| EP | 0 326 680 | A2 | | 8/1989 |
| GB | 2469719 | A | * | 10/2010 |
| JP | 63-319074 | A | | 12/1988 |
| JP | 63319074 | A | * | 12/1988 |

* cited by examiner

REINFORCED SWING BUCKET FOR USE WITH A CENTRIFUGE ROTOR

CROSS-REFERENCE TO RELATED APPLICATIONS

This application is generally related to co-pending U.S. patent application Ser. No. 12/429,561, entitled "Centrifuge Rotor," filed on even date herewith, the disclosure of which is incorporated herein by reference in its entirety.

TECHNICAL FIELD

This invention relates generally to centrifuge rotors and, more particularly, to a swing bucket for use in a high-speed centrifuge rotor.

BACKGROUND

Centrifuges are used to separate components of collected samples of biological and other materials. The samples are typically placed in tubes or other containers configured to be received in a centrifuge rotor for rapid rotation in the centrifuge. One type of centrifuge rotor includes swinging buckets pivotally coupled to a rotor body to permit the longitudinal axes of sample tubes or containers carried on the buckets to rotate from a generally vertical orientation to a generally horizontal orientation as the rotor spins during centrifugation. To balance the dynamic forces experienced during centrifugation, swing bucket rotors are typically designed to support the swing buckets in a generally symmetric arrangement around the rotational axis.

One configuration of a swing bucket centrifuge rotor supports the swing buckets through bucket supports, permitting pivotal movement of the swing buckets during centrifugation. Centrifugation causes the lower ends of the swing buckets to pivot outwardly relative to the bucket supports of the rotor, thereby applying stress to the bucket supports and/or to components of the buckets coupled to the bucket supports. This stress may cause the bucket supports and/or bucket components to fail, thereby shortening the useful life of the rotor and/or the buckets.

A need therefore exists for improved swing buckets that overcome these and other drawbacks of conventional centrifuge rotors and swing buckets.

SUMMARY

The present invention overcomes the foregoing and other shortcomings and drawbacks of swing bucket-type centrifuge rotors heretofore known. While the invention will be discussed in connection with certain embodiments, it will be understood that the invention is not limited to these embodiments. To the contrary, the invention includes all alternatives, modifications, and equivalents as may be included within the spirit and scope of the invention.

In one embodiment, a swing bucket is provided for use with a centrifuge rotor. The bucket includes a bucket body that has a side wall and a bottom wall. A pair of projections extend from the side wall on opposing sides of the bucket body and are configured for engagement with the centrifuge rotor. The bucket also includes reinforcing material coupled to the projections for restricting movement of the bucket body relative to the projections during centrifugation using the centrifuge rotor. In one aspect, the projections may include bushings that extend outwardly from the side wall for engaging corresponding pins on the centrifuge rotor. The projections may alternatively or additionally include pins for engaging corresponding journals on the centrifuge rotor. The bucket body may include a pair of diametrically opposed apertures, with each of the projections extending through one of the apertures.

In another aspect, the bucket body and/or the reinforcing material may comprise carbon fiber. The reinforcing material may, for example, comprise a continuous strand of carbon fiber. Alternatively or additionally, the reinforcing material may extend around each of the projections. The reinforcing material may be disposed in a generally U-shaped configuration extending along the side wall and across the bottom wall.

In another embodiment, a swing bucket is provided for use with a centrifuge rotor. The bucket includes a bucket body that has a side wall and a bottom wall, and a pair of bushings extending from the side wall on opposing sides of the bucket body and configured for engagement with a corresponding pair of pins of the centrifuge rotor. Reinforcing material extends around each of the bushings, and extends along the side wall and across the bottom wall to attain a generally U-shaped configuration for restricting movement of the bucket body relative to the bushings during centrifugation on the centrifuge rotor. The reinforcing material may comprise a continuous strand of carbon fiber.

In yet another embodiment, a method is provided for forming a swing bucket for use with a centrifuge rotor. The method includes obtaining a bucket body having a side wall, a bottom wall, and first and second projections extending from the side wall on opposing sides of the bucket body for engagement with the centrifuge rotor. Reinforcing material is coupled to the first and second projections and to the bucket body to restrict deflection of the projections during rotation of the centrifuge rotor. The method may include winding carbon fiber around each of the first and second projections.

Alternatively or additionally, the method may include winding carbon fiber from the first projection, across the bottom wall of the bucket body, and toward the second projection. The method may include winding carbon fiber from the second projection, across the bottom wall of the bucket body, and toward the first projection. The method may include positioning the reinforcing material on the bucket body to restrict movement of the bucket body relative to the first and second projections. The method may include curing resin-coated carbon fiber of the reinforcing material to make the reinforcing material integral with the bucket body.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
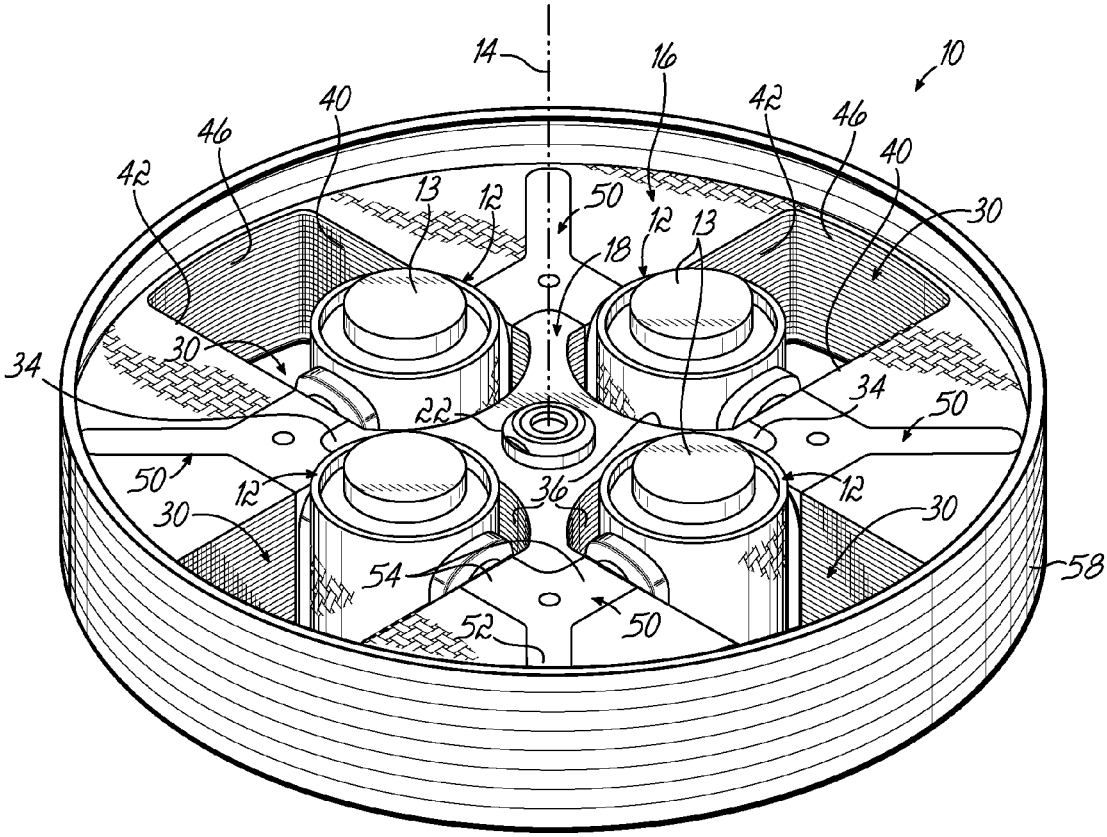
FIG. 1 is a perspective view of an exemplary swing bucket-type centrifuge rotor assembly in accordance with one embodiment of the present invention.
Figure 2:
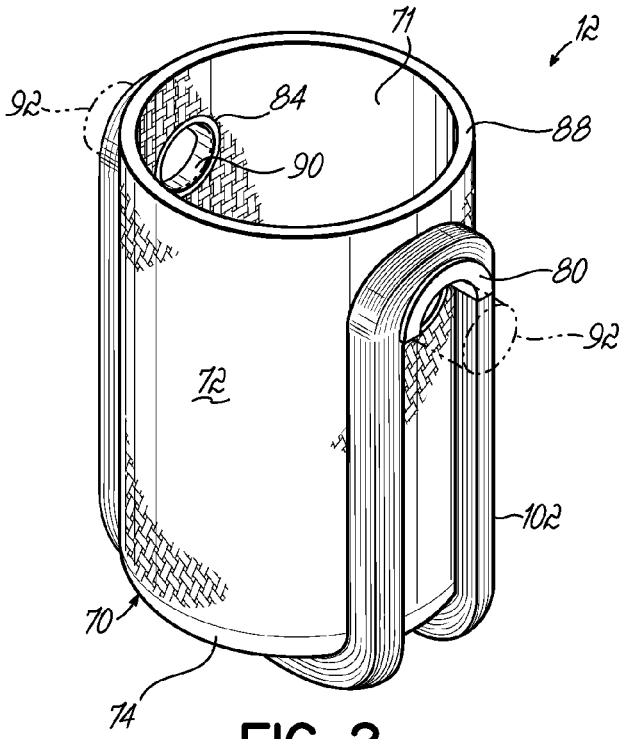
FIG. 2 is a perspective view of an exemplary swing bucket of the assembly of FIG. 1.

Referring to the figures, and more particularly to FIGS. 1 and 2, an exemplary swing bucket-type centrifuge rotor assembly 10 is illustrated in accordance with one embodiment of the present invention. The rotor assembly 10 is generally cylindrical in shape and supports a plurality of swing buckets 12, each configured to hold sample tubes or similar laboratory-type containers 13 for centrifugal rotation thereof about a central axis of rotation 14.

The rotor assembly 10 includes a rotor body 16 that supports the buckets 12 and which includes a central hub 18 that contains the axis 14. Central hub 18 is engageable by a centrifuge spindle (not shown) for rotation of the rotor assembly 10. More particularly, the central hub 18 is configured for engagement with the spindle through a coupling 22 that may be coupled to or integral with the rotor body 16, as explained in further detail below. The rotor body 16 may be formed, for example, by compression-molding and may include carbon fiber or other suitably chosen materials.

While the embodiment herein described includes four buckets 12, it is contemplated that buckets in any other number may be present instead. The central hub 18 cooperates with the rotor body 16 to define a plurality of bays 30, each configured to receive one of the buckets 12. In this regard, the central hub 18 includes, in this embodiment, four arms 34 extending radially-outwardly from a center of the central hub 18 to define curved front walls 36 of each of the bays 30, while other portions of the rotor body 16 define opposing side walls 40, 42 and back walls 46 of each of the bays 30.

With continued reference to FIGS. 1 and 2, the rotor assembly 10 includes a plurality of load transferring members 50 arranged symmetrically about the axis 14 and adjacent the bays 30. In this exemplary embodiment, the load transferring members 50 have a generally Y-shape and are configured to support the buckets 12. More particularly, each of the load transferring members 50 includes a central leg 52 and a pair of arms 54 extending therefrom, with each of the arms 54 having a bucket support 92 (FIG. 2) for supporting the buckets 12, as explained in further detail below. The bucket supports 92 permit pivotal movement of the buckets 12 during centrifugation, such that the buckets 12 may pivot, for example and without limitation, from the generally vertical orientation shown in FIG. 1, to a generally horizontal orientation. During centrifugation, the radially outward forces associated with the weight of the buckets 12 and the weight of their respective contents are transferred from the buckets 12, through the buckets bucket supports 92, to the load transferring members 50. The load transferring members 50, in turn, transfer the forces to the rotor body 16. A reinforcement layer 58 extends circumferentially around an exterior or perimeter of the rotor body 16 and provides support against the dynamic forces and stresses applied onto the rotor body 16 during centrifugation. In this exemplary embodiment, the reinforcement layer 58 includes carbon fiber.

With particular reference to FIG. 2, an exemplary swing bucket 12 of the rotor assembly 10 (FIG. 1) is illustrated. Bucket 12 includes a bucket body 70 defining an interior holding chamber 71. Bucket 12 includes, in this embodiment, a single, tubular side wall 72 and a bottom wall 74 jointly defining a generally cylindrical shape for the bucket body 70. In this regard, it is contemplated that bucket body 70 may alternatively have other shapes, having, for example, more than one side wall. For example, and without limitation, bucket body 70 may have elliptical, square, or rectangular cross-sectional shapes. Bucket 12 includes a pair of projections in the form, in this embodiment, of generally U-shaped bushings 80 extending outwardly from the side wall 72 on opposing sides of the bucket body 70. The bushings 80 extend through corresponding apertures 84 formed in the side wall 72, generally adjacent an open end 88 of the bucket 12.

The bushings 80 define respective bucket openings 90 configured to engage a corresponding pair of bucket supports 92 of the rotor assembly 10. In this embodiment, for example, the bucket supports 92 may include pins (shown in hidden lines in FIG. 2) that are received within the bucket openings 90. During set-up, and prior to centrifugation, the buckets 12 are received in respective bays 30 of the rotor assembly 10 (FIG. 1), with each of the buckets 12 being oriented to permit engagement of the pins of the bucket supports 92 with the bucket openings 90. In this particular embodiment, the buckets 12 are oriented in a generally vertical direction (as shown in FIG. 1) such that the pins of the bucket supports 92 are received within an open portion of the generally U-shaped bushings 80. During centrifugation, the closed portions of the bushings 80 engage the bucket supports 92 and retain the buckets 12 on the pins thereof as the buckets 12 rotate toward a generally horizontal orientation.

Bucket 12 further includes reinforcing material 102 coupled to the bushings 80 to restrict movement of the bucket body 70 relative to the bushings 80 and relative to the pins of the bucket supports 92. In the embodiment shown, the reinforcing material 102 extends between the bushings 80, along the side wall 72 on diametrically opposite sides of the bucket body 70, and across the bottom wall 74, to thereby prevent relative movement of the bucket body 70 during high speed centrifugal rotation. The reinforcing material 102 is applied in a generally U-shaped configuration around the bucket body 70. In this exemplary embodiment, moreover, the reinforcement material 102 is wound around the bushings 80, more specifically over the closed portion of the bushings 80, to also define a generally U-shaped configuration around each of the bushings 80. It is contemplated that the reinforcing material 102 may be coupled to the bushings 80 through other methods and/or components and the illustrated winding thereof around the bushings 80 of this embodiment is intended to be exemplary rather than limiting.

During centrifugation, the dynamic tendency of the bucket body 70 to move outwardly is resisted or eliminated by the reinforcing material 102, which restricts radially outward movement of the bucket body 70 relative to the bushings 80. This restriction thereby limits the deflection of the bushings 80 as well as deflection of the pins of the bucket supports 92 extending through the bucket openings 90. The reinforcement material 102 is made of a suitably chosen material that has a tensile strength sufficient to resist dynamic loads experienced by the bucket 12. In a specific embodiment, for example, the reinforcing material 102 includes elongate carbon fiber tows or strands, although other materials may alternatively be used.

Figure 3:
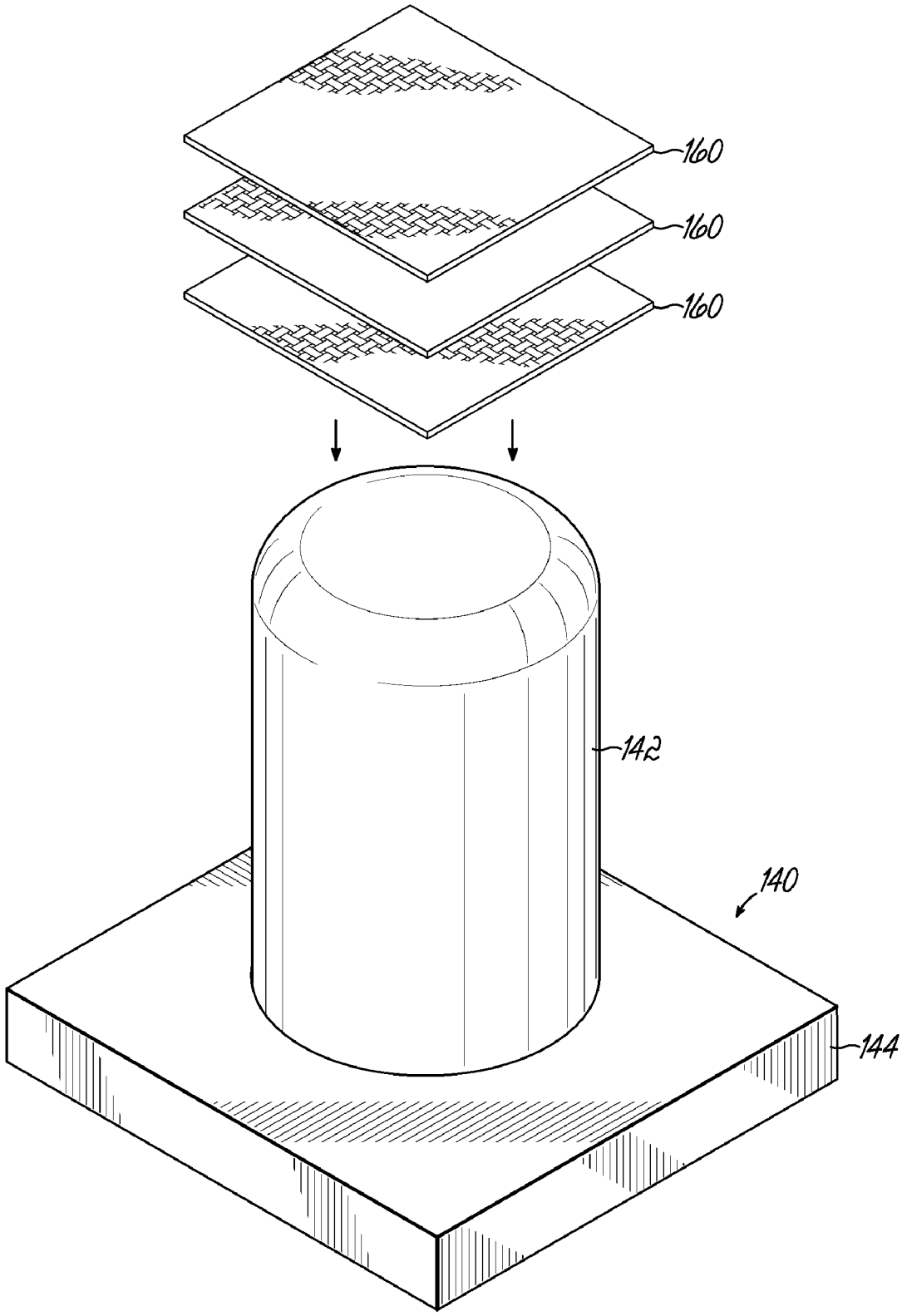
FIG. 3 is a perspective view illustrating an exemplary process for forming the swing bucket of FIG. 2.
Figure 4:
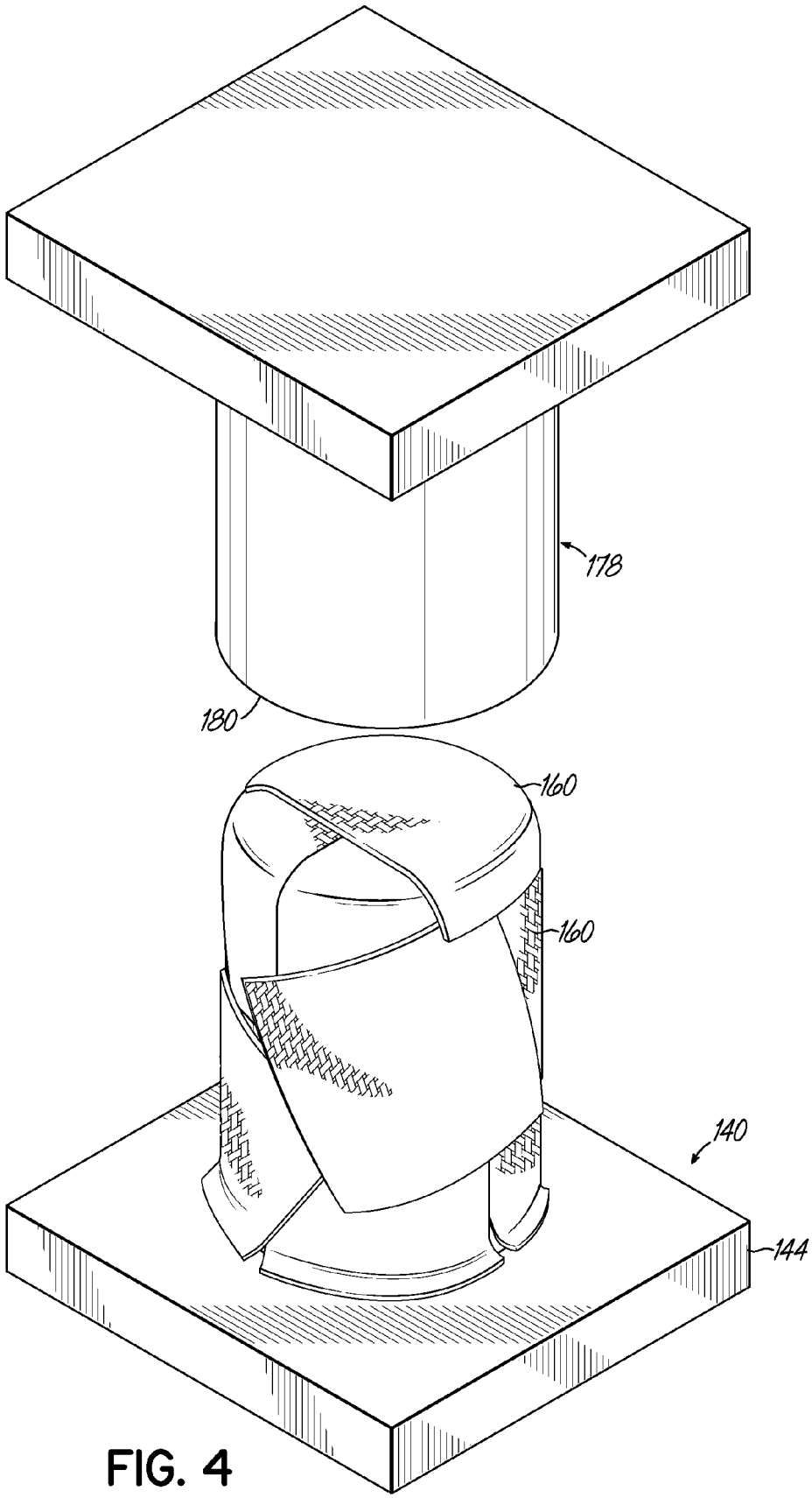
FIG. 4 is a perspective view illustrating another step in the process for forming the swing bucket of FIG. 2.

With reference to FIGS. 3-6, an exemplary process for forming the swing bucket 12 is illustrated. With particular reference to FIGS. 3-4, a first mold part 140 includes a protruding portion 142 corresponding to the shape of the interior holding chamber 71 of the bucket body 70 (FIG. 2) and extending from a base 144. One or more layers 160 of a suitably chosen material are disposed over the protruding portion 142 and are wrapped to fit closely over the protruding portion 142 in randomly selected orientations, for example, to thereby cover the protruding portion 142, as illustrated in FIG. 4. It will be appreciated that the number, dimensions, and/or orientations of the layers 160 may be alternatively different from those shown in FIG. 4. For example, an embodiment may include a single layer 160 rather than the illustrated plurality thereof. Likewise, an embodiment may include layers oriented in a non-randomized arrangement.

A second mold part 178 is mated with the first mold part 140 to apply pressure and/or heat to the layers 160. More specifically, second mold part 178 includes a female cavity portion 180 shaped to closely match the shape of the protruding portion 142 of the first mold part 140 such that when the first and second mold parts 140, 178 are mated together, pressure may be applied to the layers 160 to thereby define the resulting shape of the bucket body 70.

Figure 5:
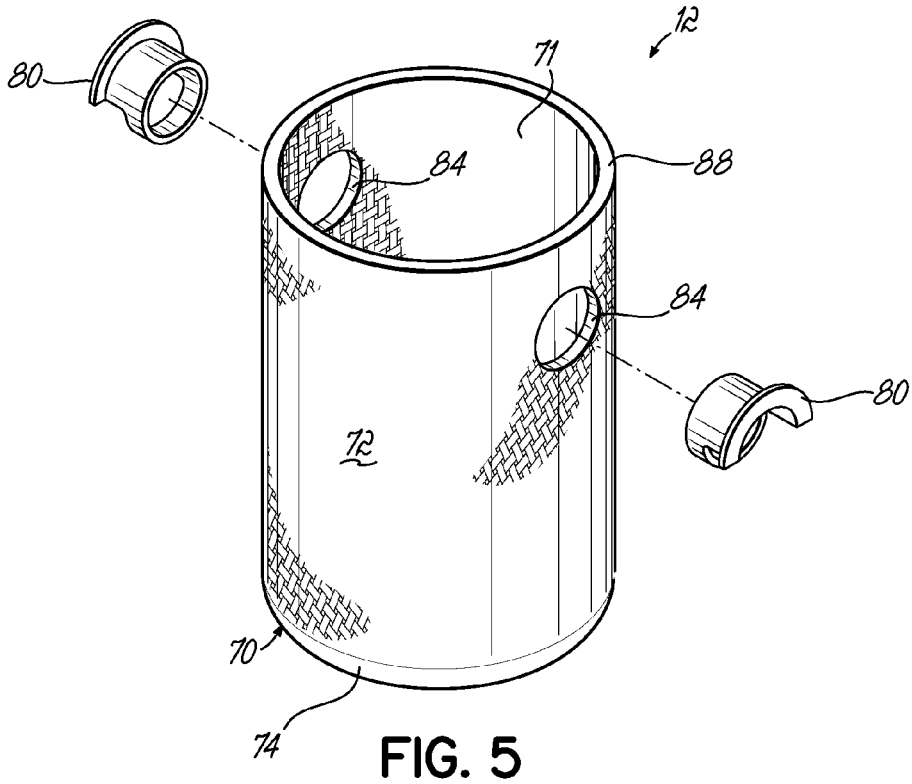
FIG. 5 is a perspective view illustrating yet another step in the process for forming the swing bucket of FIG. 2.
Figure 6:
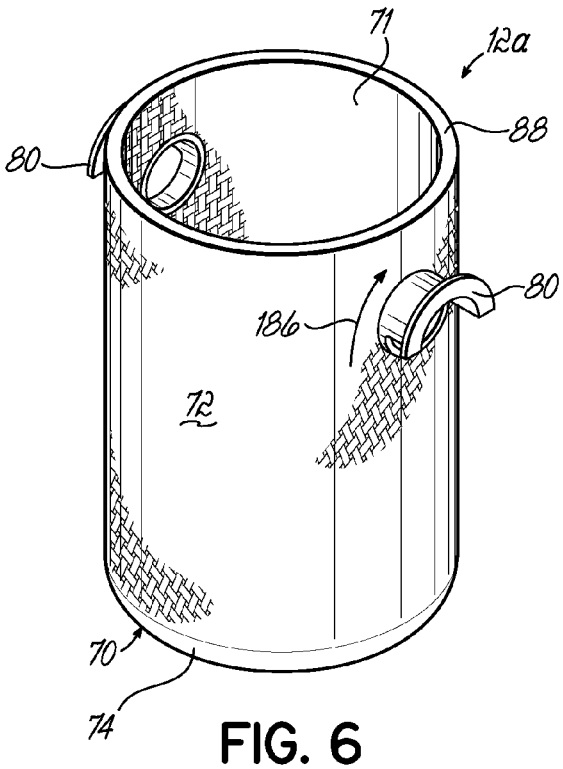
FIG. 6 is a perspective view of another embodiment of a partially-formed swing bucket.

With particular reference to FIGS. 5, 5A, 5B, and 6, where similar numbers refer to similar features, in addition to or within the process described above, the apertures 84 are formed on the side wall 72 to thereby yield the exemplary bucket body 70 illustrated in FIG. 5. The bushings 80 may then be inserted through the apertures 84 and re-oriented, if necessary (arrow 186), such that the open portions thereof generally face the bottom wall 74. While FIG. 5 generally illustrates a bucket body 70 formed by a compression-molding process, as described above, it is contemplated that, alternatively or additionally, bucket body 70 may be formed by a different process. For example, and without limitation, the bucket body 70 may be formed by an injection-molding process, as illustrated by the exemplary bucket body 70*a* (FIG. 5A), by a filament-winding process, as illustrated by the exemplary bucket body 70*b* (FIG. 5B), or by a resin transfer molding ("RTM") process.

Figure 5A:
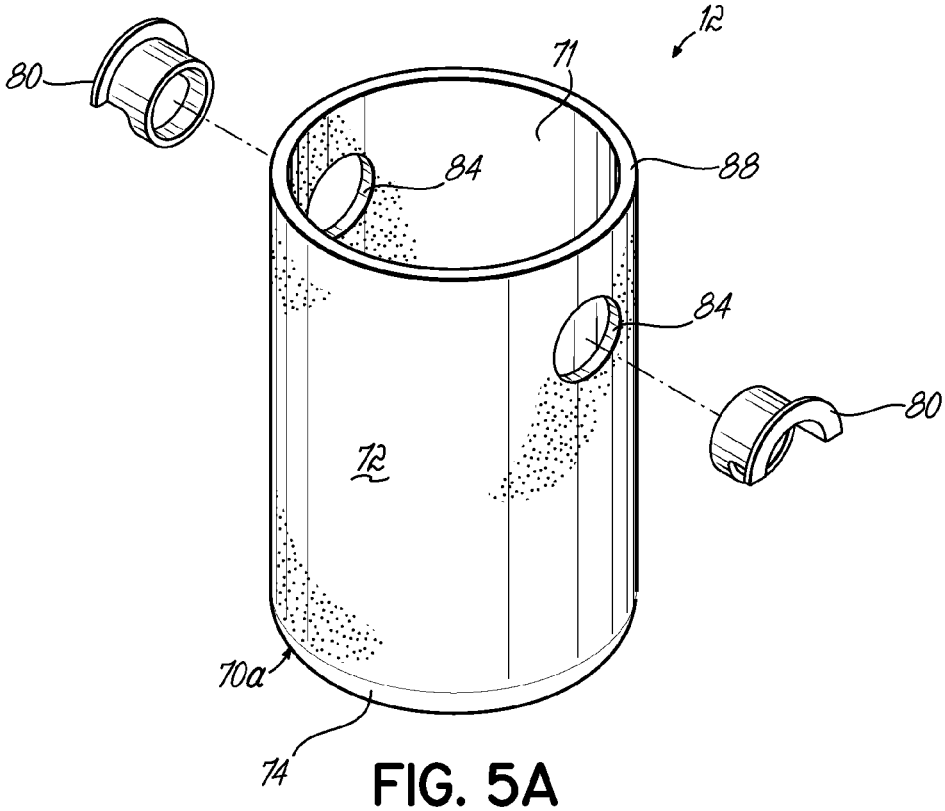
FIG. 5A is a perspective view similar to FIG. 5, illustrating an alternative embodiment of a partially-formed swing bucket.
Figure 5B:
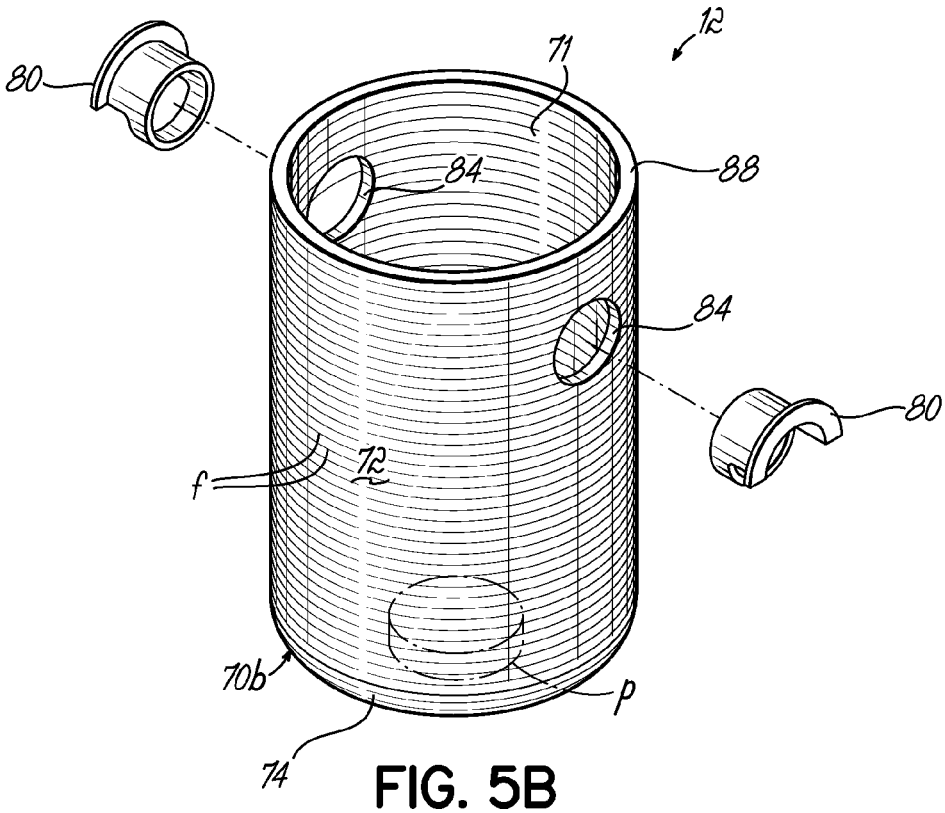
FIG. 5B is a perspective view similar to FIGS. 5 and 5A, illustrating yet another alternative embodiment of a partially-formed swing bucket.

With particular reference to FIG. 5A, the exemplary molded bucket body 70*a* may, for example, be include a filler material, such as glass filler, chopped carbon fibers, or other suitable filler materials. Alternatively, the molded bucket body 70*a* may be formed without filler materials. With particular reference to FIG. 5B, the exemplary bucket body 70*b* may, for example, be formed by winding one or more filaments (f) around a mandrel (not shown). The closed end of the bucket body 70*b* may comprise a plug p (shown in phantom). Alternatively, portions of a filament-wound bucket body 70*b* may be molded to thereby define the interior holding chamber 71. Forming of the bucket body 70 by an RTM process may or may not include filling portions of the bucket body 70 with a filler material, such as glass filler or chopped fibers, for example.

Referring again to FIG. 5, while the figure illustrates coupling of the bushings 80 with the bucket body 70 after forming of the bucket body 70, this is intended to be illustrative rather than limiting. More specifically, for example, the bushings 80 may be coupled to the bucket body 70 during the molding process described above with respect to FIGS. 3-4. Coupling of the bushings 80 with the bucket body 70 yields the partially formed bucket 12*a* of FIG. 6.

Figure 7:
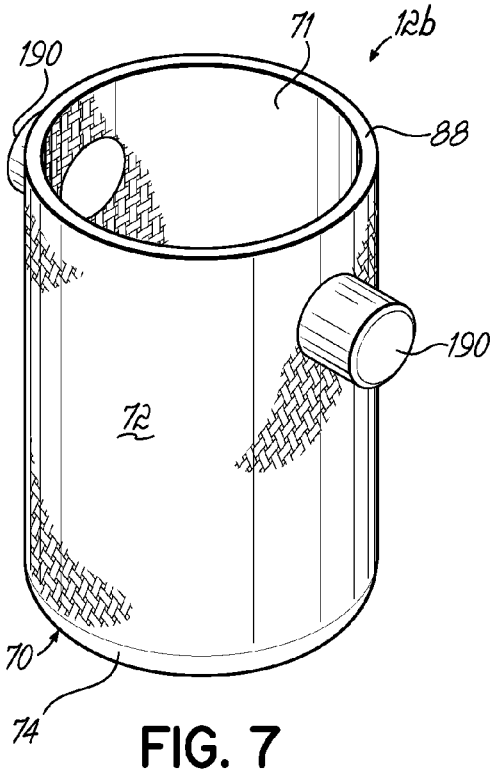
FIG. 7 is a perspective view of yet another embodiment of a partially-formed swing bucket.

With reference to FIG. 7, an alternative embodiment of a partially formed bucket 12*b* is illustrated. For ease of understanding, similar reference numerals in FIG. 7 refer to similar features in the preceding figures. Partially formed bucket 12*b* includes a pair of projections in the form of pins 190, configured to be received within corresponding journals of the centrifuge rotor (e.g., on the load transferring members 50 of FIG. 1). Those of ordinary skill in the art will readily appreciate that this embodiment of the partially formed bucket 12*b* may be combined with one or more of the other features described herein with respect to the embodiments of the other figures.

Figure 8:
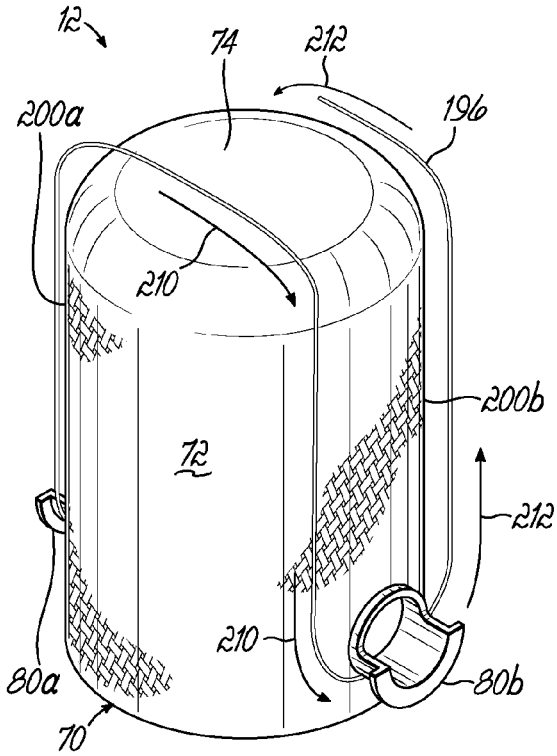
FIG. 8 is a perspective view illustrating an exemplary process for applying a reinforcing material to form the swing bucket of FIG. 2.
Figure 9:
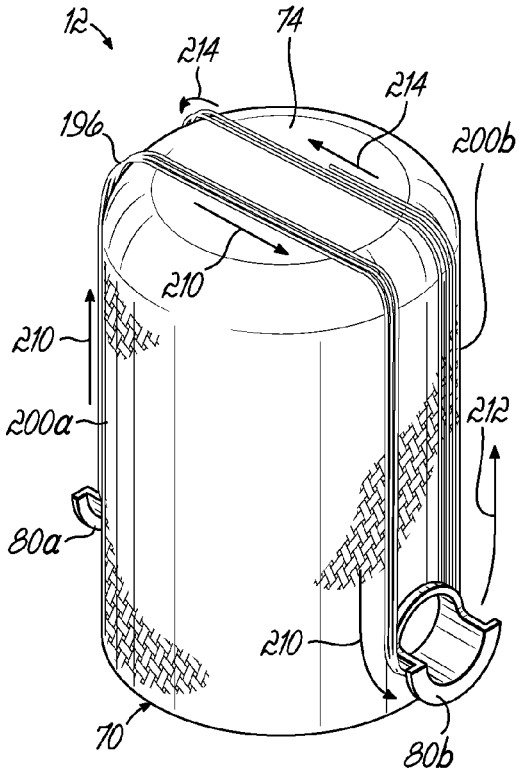
FIG. 9 is a perspective view illustrating another step in the exemplary process of FIG. 8 for applying the reinforcing material to form the swing bucket of FIG. 2.

With reference to FIGS. 8-9, an exemplary process is illustrated for applying the reinforcing material 102 to form the bucket 12. In this embodiment, a continuous strand of material, such as a resin-coated tow 196 of carbon fiber, is directed sequentially from a first bushing 80*a*, longitudinally along a portion of the side wall 72 on a first side 200*a* of the bucket body 70, across the bottom wall 74, and longitudinally along a portion of the side wall 72 on a second, opposite side 200*b* of the bucket body 70 toward a second bushing 80*b* (arrows 210). The tow 196 is then directed around the second bushing 80*b* and longitudinally along the portion of side wall 72 on the second side 200*b*, away from the second bushing 80*b* (arrows 212).

The tow 196 is directed across the bottom wall 74 in a direction from the second side 200*b* toward the first side 200*a* and longitudinally along the portion of side wall 72 on the first side 200*a* toward the first bushing 80*a* (arrows 214). Finally, the tow 196 is directed around the first bushing 80*a* and directed again, as described above, toward the second bushing 80*b* (arrows 210). The process of winding tow 196 around the bushings 80*a*, 80*b* is repeated until sufficient reinforcing material 102 has been applied to resist dynamic forces that may be experienced by bucket 12 during centrifugation.

In the exemplary embodiment shown and described herein, pressure and/or heat may be applied to the tow 196 to cure the resin covering the tow 196, thereby making the reinforcing material 102 integral with the bucket body 70 and/or with the bushings 80. One exemplary tow suitable for the above-described reinforcing material 102 is, without limitation, 24K carbon fiber tows commercially available from Toray Industries, Inc. of Tokyo, Japan. It will be appreciated that various other materials may alternatively be used to form the reinforcing material 102. For example, and without limitation, the reinforcing material 102 may be formed from high strength fibers, such as aramid fibers or UHMW (Ultra High Molecular Weight) polyolefin, which may or may not be coated with a thermoplastic or thermosetting resin. Moreover, alternative reinforcing material 102 may be formed by applying an uncoated or "dry" fiber, in the manner described above, and injecting a resin onto the fiber, for example, by a resin transfer molding (RTM) process.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A bucket for use with a centrifuge rotor, comprising:
a bucket body including a side wall and a bottom wall;
a pair of projections extending from said side wall on opposing sides of said bucket body and configured for engagement with corresponding bucket supports on the centrifuge rotor, the projections comprising one of:
bushings for engaging corresponding pins on the centrifuge rotor, or
pins for engaging corresponding journals on the centrifuge rotor; and
reinforcing material coupled to said projections and extending across the bottom wall for restricting movement of said bucket body relative to said projections during centrifugation on the centrifuge rotor.

2. The bucket of claim 1, wherein said bucket body includes a pair of diametrically opposed apertures, each of said projections extending through one of said apertures.

3. The bucket of claim 1, wherein said bucket body comprises carbon fiber.

4. The bucket of claim 1, wherein said reinforcing material comprises carbon fiber.

5. The bucket of claim 4, wherein said reinforcing material comprises a continuous strand of carbon fiber.

6. The bucket of claim 1, wherein said reinforcing material extends around each of said projections.

7. The bucket of claim 1, wherein said reinforcing material is disposed in a generally U-shaped configuration extending along said side wall and across said bottom wall.

8. A bucket for use with a centrifuge rotor, comprising:
a bucket body including a side wall and a bottom wall;
a pair of bushings extending from said side wall on opposing sides of said bucket body and configured for engagement with a corresponding pair of pins of the centrifuge rotor; and
reinforcing material extending around said bushings and extending along said side wall and across said bottom wall and having a generally U-shaped configuration for restricting movement of said bucket body relative to said bushings during rotation of the centrifuge rotor.

9. The bucket of claim 8, wherein said reinforcing material comprises a continuous strand of carbon fiber.

10. A bucket for use with a centrifuge rotor, comprising:
a bucket body including a bottom wall, an open end opposite said bottom wall, and at least one sidewall extending between said bottom wall and said open end;
first and second projections extending from said sidewall on opposing sides of said bucket body; and
reinforcing material coupled to said first and second projections and extending around said first projection, along said sidewall on the side of said bucket body adjacent said first projection, across said bottom wall, along said sidewall on the side of said bucket body adjacent said second projection, and around said second projection.

* * * * *